US005143153A

United States Patent [19]

Bach et al.

[11] Patent Number: 5,143,153

[45] Date of Patent: Sep. 1, 1992

[54] ROTARY OIL WELL PUMP AND SUCKER ROD LIFT

[76] Inventors: Ronald L. Bach, 727 M113; Richard G. Bach, 7604 Henry, both of Kingsley, Mich. 49649

[21] Appl. No.: 738,341

[22] Filed: Jul. 31, 1991

[51] Int. Cl.[5] ..... E21B 19/00

[52] U.S. Cl. ..... 166/68.5; 166/77.5; 166/105

[58] Field of Search ..... 166/68.5, 72, 77.5, 166/78, 85, 105; 175/107

[56] References Cited

U.S. PATENT DOCUMENTS

| | | | |
|---|---|---|---|
| 2,869,469 | 1/1959 | Williams | 166/78 X |
| 2,957,427 | 10/1960 | O'Connor . | |
| 3,062,290 | 11/1962 | Beckett | 166/68 |
| 3,282,357 | 11/1966 | Bunn . | |
| 3,347,169 | 10/1967 | Cronin, Jr. et al. . | |
| 3,404,741 | 10/1968 | Gheorghe et al. | 175/85 |
| 4,251,176 | 2/1981 | Sizer et al. | 414/22 |
| 4,479,537 | 10/1984 | Reed | 166/77 |
| 4,595,062 | 6/1986 | Boyadjieff et al. | 166/85 X |
| 4,745,969 | 5/1988 | Henderson | 166/68.5 |
| 4,797,075 | 1/1989 | Edwards et al. | 418/48 |
| 4,890,671 | 1/1990 | Baxter | 166/77.5 X |
| 4,901,793 | 2/1990 | Weber | 166/68.5 |

*Primary Examiner*—William P. Neuder

*Attorney, Agent, or Firm*—Varnum, Riddering, Schmidt & Howlett

[57] ABSTRACT

A sucker rod lifting apparatus (10) for use with downhole rotary oil well pumps having a pump rotor (42) disposed within a pump stator (44) comprises at least one hydraulic cylinder (16) between a first carrier plate (14) and the ground, a fluid circuit (82, 84) connected to the hydraulic cylinder (16) to raise and lower the first carrier plate (14) with respect to the ground, and a control valve (76) in the fluid circuit to selectively control the flow of fluid. Thus, the control valve (76) is capable of selectively controlling the raising and lowering of the first carrier plate (14) with respect to the ground to thereby selectively raise and lower the sucker rod (40) and the pump rotor (42) with respect to the pump stator (44).

15 Claims, 4 Drawing Sheets

ROTARY OIL WELL PUMP AND SUCKER ROD LIFT

BACKGROUND OF THE INVENTION

1. Field of the Invention

This invention relates in general to a submersible rotary well pump and in particular to a mechanism for lifting the sucker rod associated therewith.

2. Description of the Related Art

A progressing cavity well pump assembly or rotary well pump assembly includes an electric or hydraulic motor located at the surface of the ground. The motor rotatively drives an elongated rod which is attached to a sucker rod. The sucker rod extends downwardly to a rotary well pump placed down in the well in the area of the fluids to be pumped (downhole pump). Conventional rotary well pumps include a rotor having a helical outer surface shaped in the manner of a corkscrew and a stator having a corkscrew-like helical channel on its inside surface. As the rotor turns within the stator, cavities are formed which progress from the bottom of the pump to the top of the pump, thereby transporting fluids up through the pump and into a string of rods (production tubing or "tubing string") that encase the sucker rod.

During the production of oil, particularly in areas having high concentrations of clay, silt or unconsolidated oil sands, the rotor can become stuck inside the stator or an excessively high torque can be exerted on the motor. In such instances, it becomes necessary to raise and then lower the sucker rod to either free up the attached rotor or reduce the driving torque exerted on the motor. Conventionally, this vertical movement of the rotor and sucker rod has been accomplished by moving a work-over rig to the well, disconnecting a substantial amount of surface equipment, and then lifting and lowering the elongated rod and attached sucker rod using a hoist of the work-over rig. The use of such a work-over rig is inconvenient and expensive because of the cost of moving the rig to the well, the cost associated with the disconnection and reconnection of surface equipment, and the substantial loss of production during the time the surface equipment is being disconnected and reconnected.

U.S. Pat. No. 3,062,290 issued Nov. 6, 1962 to Beckett discloses an apparatus having a sucker rod for driving the plunger of a reciprocating oil well pump connected in a tubing string. The apparatus includes a hydraulic cylinder for reciprocating the sucker rod and two separate hydraulic ram cylinders for periodically producing flow reversals to agitate silt and other materials plugging the formation. The flow reversal means includes the tubing string supported by piston rods which are adapted to move periodically up and down in hydraulic ram cylinders. Movement of the piston rods causes movement of the tubing string within a well casing. When the tubing string is lowered, downwardly acting swabs disposed on the tubing string contact the inner surface of the well casing and cause a flow from the well into the formation, thereby unplugging the formation.

U.S. Pat. No. 4,479,537 issued Oct. 30, 1984 to Reed discloses the use of hydraulic cylinders to lift a tubing string out of the casing of an oil well. The hydraulic lifting apparatus is used in connection with an electric motor driven downhole pump located near the lower end of the tubing string. The apparatus includes a clamp for successively gripping and releasing sections of the tubing string to pull the tubing string out of the well casing in stages. The tubing string sections can be removed for the purpose of replacing an electrical connector on the electric motor that powers the downhole pump.

The Reed apparatus requires a removal or disconnection and reconnection of surface equipment in order to be utilized. Accordingly, production downtime is encountered whenever an electrical connector needs to be replaced. In addition, neither the Beckett or Reed apparatus is adapted to be used with a rotary well pump. Heretofore, there has been no convenient and economical lift mechanism which is capable of dislodging a stuck rotor from a stator and either returning the rotor to its original position in the stator or repositioning the rotor within the stator. In particular, there has been no lift mechanism for conducting a lifting operation without a dismantling of surface equipment or piping and without causing a loss of pressure at the surface, thereby permitting substantially continuous production of oil at the well.

SUMMARY OF THE INVENTION

According to the invention, there is provided an improved apparatus for pumping oil from a well which includes a well casing and a tubing string mounted in the well casing. A rotary pump stator is mounted to the lower end of the tubing string. A first carrier plate is supported on the ground above the well casing and a sucker rod disposed in the well casing and supported by the first carrier plate. A rotary pump rotor is mounted to the lower end of the sucker rod and in register with the rotary pump stator for pumping fluid from a producing formation at the lower end of the tubing string. A motor is mounted to the first carrier plate and is coupled to the sucker rod to rotatively drive the sucker rod and the pump rotor.

According to the invention, at least one fluid cylinder is mounted between the first carrier plate and the ground. A fluid circuit is connected to the fluid cylinder to raise and lower the first carrier plate with respect to the ground. A control valve in the fluid circuit selectively controls the flow of fluid to the fluid cylinder. Thus, the control valve is capable of selectively raising and lowering of the first carrier plate with respect to the ground to thereby selectively raise and lower the sucker rod and the pump rotor with respect to the pump stator. Preferably, a second carrier plate is mounted to a lower portion of the fluid cylinder and supported on the well casing or on the ground.

In one aspect of the invention, the motor comprises a hydraulic motor, the cylinder is a hydraulic cylinder and the fluid circuit includes the hydraulic motor and the hydraulic cylinder. Typically, the control valve has a position to permit fluid flow to the hydraulic cylinder and to the hydraulic motor simultaneously. The control valve preferably has a second position to block the flow of fluid to the hydraulic motor while permitting fluid flow to the hydraulic cylinder.

Preferably, there are two cylinders, one on each side of the sucker rod.

In another aspect of the invention, an electric motor drives the sucker rod.

In another of its aspects, the invention relates to an oil pumping apparatus wherein the sucker rod is connected to the motor through a plurality of elongated rods which extend through a stuffing box, and a clamp is adapted to mount to one of the elongated rods and rest on the stuffing box to hold the sucker rod in a predetermined raised position. Such a construction permits removal of another elongated rod above the one elongated rod after the elongated rods have been raised by the fluid cylinder. Preferably, the invention further includes a second clamp supported by the first carrier plate and adapted to mount to another of the elongated rods above the first carrier plate to raise the elongated rods with the first carrier plate as the fluid cylinder raises the first carrier plate.

The invention can include a vertical support mounted on the first carrier plate and a bracket extending laterally from the vertical support, wherein the motor is supported on the bracket so that the motor can be raised with respect to the first carrier plate.

In a preferred embodiment of the invention means are provided to rotate the sucker rod and the rotor while raising the first carrier plate and the rotor with respect to the ground.

The invention provides a means to raise and lower the pump rotor with respect to the stator while simultaneously rotating the rotor and further without disconnecting the pumping equipment. Thus, little or no down time or even loss of oil well pressure is required to free a stuck rotary pump with the invention. The lift mechanism of the invention is convenient to use and economically built into the pumping and associated wellhead equipment.

BRIEF DESCRIPTION OF THE DRAWINGS

The invention will now be described with reference to the drawings in which.

DETAILED DESCRIPTION OF THE PREFERRED EMBODIMENTS

Figure 1:
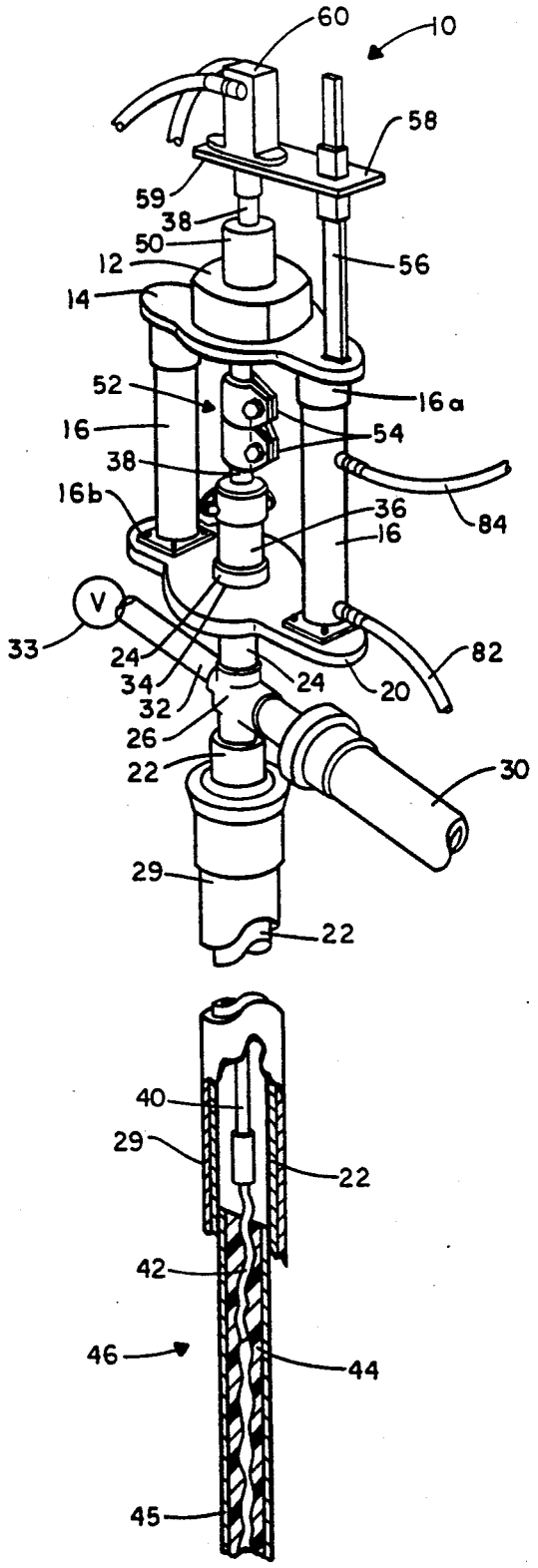
FIG. 1 is a perspective view, partly in longitudinal section, of an apparatus for lifting a sucker rod wherein the apparatus includes hydraulic cylinders having internal piston rods located in a first, retracted position.
Figure 2:
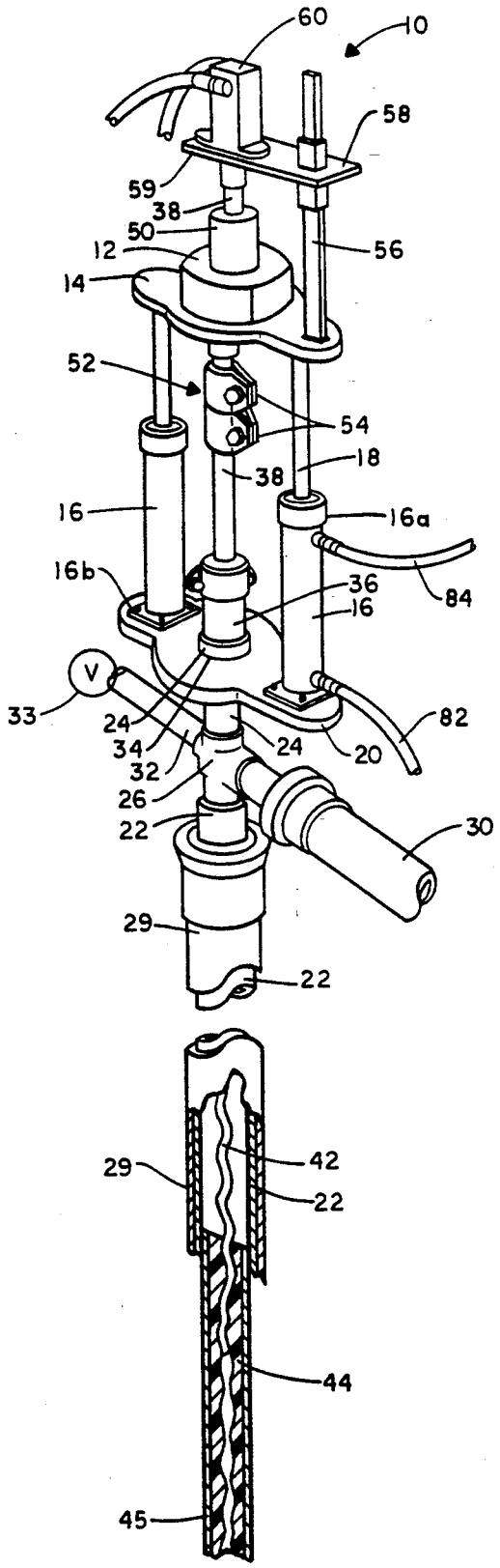
FIG. 2 is a perspective view similar to FIG. 1 but showing the piston rods in a second, extended position.

Referring now to the drawings, a sucker rod lifting apparatus 10 is shown in FIGS. 1 and 2. The apparatus 10 includes a load bearing 12 mounted on an upper carrier plate 14. The upper carrier plate 14 is supported by piston rods 18 (FIG. 2) which extend upwardly from upper ends 16*a* of two hydraulic cylinders 16. The hydraulic cylinders 16 include lower ends 16*b* which are fastened to a lower carrier plate 20. Thus, the lower carrier plate 20 supports the weight of the hydraulic cylinders 16 and the load carried by the hydraulic cylinders 16.

A threaded collar 24 extends through a central aperture 34 in the lower carrier plate 20 and is preferably integrally formed with the surfaces of the lower carrier plate 20 which define the aperture 34. A stuffing box 36 is threaded into an upper end of the threaded collar 24. As is well known in the art, a pressure seal is maintained across a packing (not shown) inside the stuffing box 36. The packing preferably comprises a conventional self-lubricating packing having eight packing rings. The threaded collar 24 extends below the lower carrier plate 20 and has a lower end threaded to an upper end of a fitting 26. A diametrically opposed end of the fitting 26 is threaded to an upper end of a tubing string 22 which extends downwardly through a well casing 29 in a conventional manner. A production piping 30 can be threaded to one side of the fitting 26 for removing water or oil from the well. A nipple 32 extending to a bleed valve 33 can be threaded to the opposing side of the fitting 26. The bleed valve 33 can be used to take production samples from the well. Accordingly, the fitting 26 preferably includes four threaded portions.

The load bearing 12, which will be described in greater detail below, is adapted to receive an elongated rod 38 that rotates about a vertical axis. The elongated rod 38 extends downwardly into the stuffing box 36 and through the packing. Inside the stuffing box 36 but below the packing, the elongated rod 38 is connected (preferably threaded) to a sucker rod 40 (FIG. 1) which extends through the threaded collar 24, the fitting 26 and the tubing string 22.

A bottom end of the sucker rod 40 is mounted (preferably threaded) to a single helix rotor 42 which rotates about a vertical axis inside a double helix elastomeric stator 44. The stator 44 is encased by a sleeve 45 which preferably comprises a thermoplastic material. The sleeve 45 is threaded to a lowermost section of the tubing string 22. The rotor 42 and stator 44 form the major components of a rotary well pump 46. The rotary well pump 46 can also be referred to as a progressing cavity pump or downhole pump which can comprise an appropriately sized Moyno® Down-Hole oil well pump manufactured by Moyno Oilfield Products of Tulsa, Okla., a division of Robbins & Myers, Inc.

An upper clamp 50 is disposed immediately above the load bearing 12. As is shown in FIGS. 1 and 2, the elongated rod 38 extends upwardly through the load bearing 12 and the upper clamp 50. The upper clamp 50 comprises a conventional self-locking slip-type clamping mechanism which is generally round and balanced for rotary motion. Disposed below the upper carrier plate 14 is a lower clamp assembly 52 comprising two lower clamps 54 which, like the upper clamp 50, are appropriately sized to grip and support the elongated rod 38 and the attached sucker rod 40 and rotor 42. Unlike the upper clamp 50, the lower clamps 54 are not balanced for rotary motion and hence, suffer from vibration when the elongated rod 38 is rotatively driven.

Extending upwardly from a side of the upper carrier plate 14 is a vertical support 56 which is preferably welded to the upper carrier plate 14. A horizontal bracket 58 is securely attached, preferably welded, to the vertical support 56. The horizontal bracket 58 includes an aperture (not shown) which extends from a bottom surface of the horizontal bracket 58 to a top surface of the horizontal bracket 58. The aperture is adapted to receive the elongated rod 38 therethrough without any interference. Attached to the top surface of the horizontal bracket 58 and surrounding the aperture is a sleeve 59. An appropriately sized motor, preferably a hydraulic motor 60, is seated within the sleeve 59 which prevents the motor 60 from rotating. The motor 60 is vertically, movably supported by the upper surface of the horizontal bracket 58.

Figure 3:
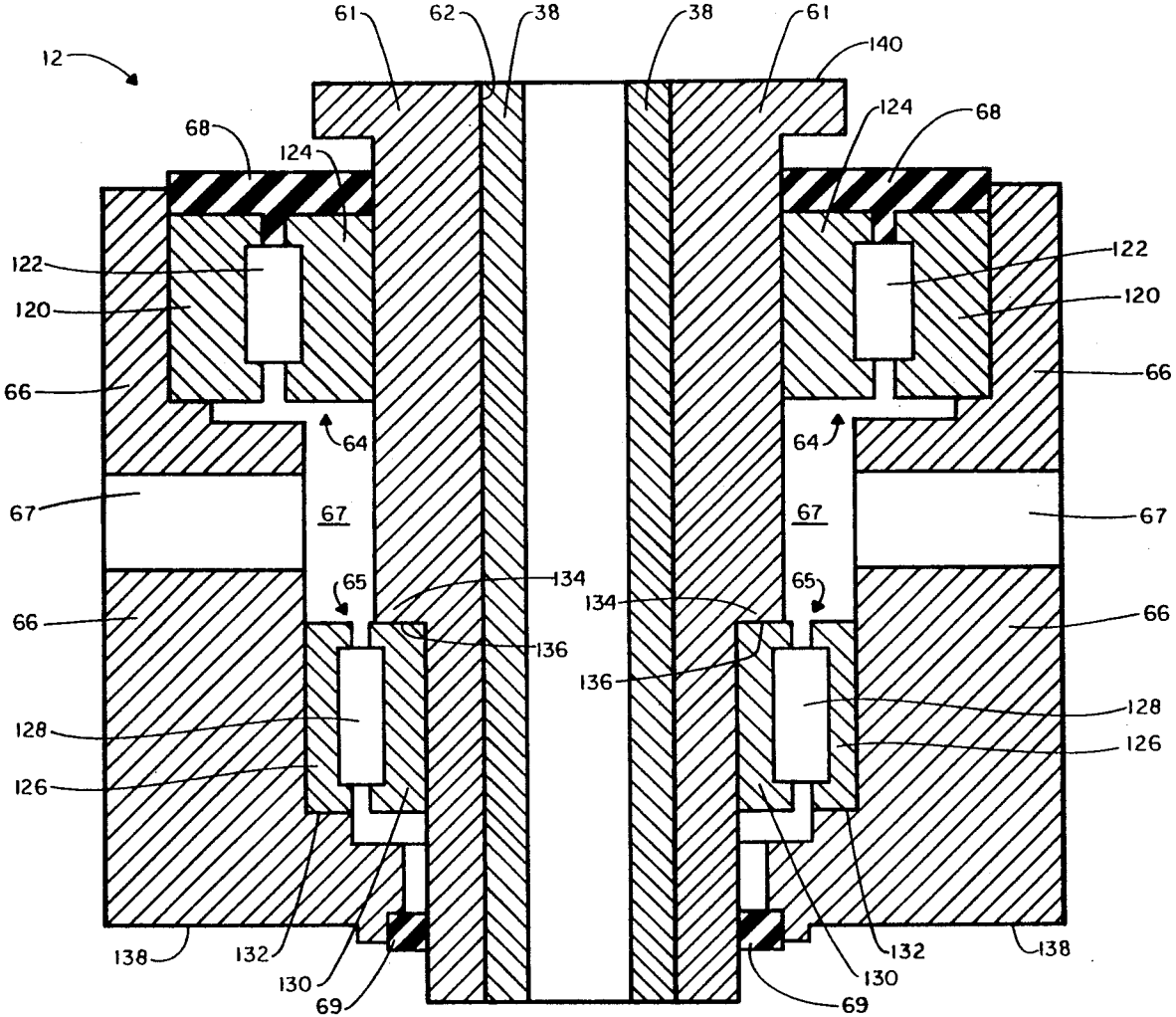
FIG. 3 is an enlarged vertical section taken through a load bearing forming part of the sucker rod lifting apparatus.

Referring now to FIG. 3, the load bearing 12 is shown in detail. The load bearing 12 includes a shaft 61 having a centrally disposed vertical bore 62 which receives the elongated rod 38 in a press fit relationship. The shaft 61 is surrounded by an upper tapered roller bearing 64 and a lower tapered roller bearing 65. The upper bearing 64 comprises an outer race 120, a roller 122 and an inner race 124. The shaft 61 is press fit into the inner race 124 of the upper bearing 64. The outer race 120 of the upper bearing 64 is in turn press fit into a housing 66 of the load bearing 12.

The lower bearing 65 comprises an outer race 126, a roller 128 and an inner race 130. The outer race 126 is press fit into the housing 66 of the load bearing 12 and is vertically supported by a shoulder 132 of the housing 66. The shaft 61 is press fit into the inner race 130 of the lower bearing 65. In addition, the shaft 61 is formed with an annular flange 134 which rests upon an upper surface 136 of the inner race 130. The lower bearing 65 is adapted to support the vertical load carried by the shaft 61, and carries this vertical load across the upper surface 136. This vertical load is communicated through the roller 128 of the lower bearing 65. The roller 128 of the lower bearing 65 in turn communicates this vertical load to the outer race 126. The outer race 126 is press fit into the housing 66 of the load bearing 12 and is vertically supported by a shoulder 132 of the housing 66. Thus, the vertical load carried by the outer race 126 is communicated to the housing 66 of the load bearing 12 by way of the shoulder 132. The vertical load carried by the housing 66 is communicated to the upper carrier plate 14 (FIG. 1) along a lower surface 138 of the housing 66.

As previously noted, the upper clamp 50 is adapted to grasp the elongated rod 38. Thus, the upper clamp 50 supports a very heavy vertical load by clamping onto the elongated rod 38. The upper clamp 50 rests directly on an upper surface 140 (FIG. 3) of the shaft 61 but need not be fastened thereto. The heavy vertical load which is carried by the upper clamp 50 and transmitted to the shaft 61 along the upper surface 140 of the shaft 61 creates a sufficient amount of friction between the lower surface of the upper clamp 50 and the upper surface 140 of the shaft 61 that the upper clamp 50 need not be fastened to the shaft 61.

In operation, as the elongated rod 38 rotates, the upper clamp 50 also rotates, thereby also causing the shaft 61 to rotate because of the frictional interface between the upper clamp 50 and the shaft 61. Since the shaft 61 is press fit into the inner races 124, 130 of the bearings 64, 65, respectively, the inner races also rotate with the shaft 61. Since the outer races 120, 126 of the bearings 64, 65, respectively, are press fit into the stationary housing 66 of the load bearing 12, the outer races 120, 126 do not rotate. Therefore, the rollers 122, 128 of the bearings 64, 65, respectively, serve to minimize friction between the rotating inner races 124, 130 and the stationary outer races 120, 126, respectively. In addition, as previously discussed, the lower bearing 65 is also adapted to support vertical loads, and transmits the vertical load carried by the shaft 61 to the housing 66 of the load bearing 12. Conversely, the upper bearing 64 merely serves to transmit lateral loads from the shaft 61 into the housing 66. In this fashion, the upper bearing 64 prevents the shaft 61 from wobbling.

A lubricant can be circulated through a system of passageways 67 provided in the load bearing 12. These passageways 67 directly communicate with the rollers 122, 128 of the bearings 64, 65, respectively. This fluid communication provides lubrication to the rollers to reduce friction and enhances the useful life of the bearings 64, 65. Preferably, the lubricant comprises a portion of the hydraulic fluid which has been utilized to power the hydraulic motor 60 and then drained from the motor 60. In the most preferred embodiment of the invention, a portion of the hydraulic fluid draining from the motor 60 is continuously circulated through the load bearing 12 and then returned to a hydraulic fluid reservoir (described in further detail below) and reused. Seals 68, 69 are provided at upper and lower ends of the load bearing 12 to maintain a pressure seal at each end of the load bearing 12.

Figure 4:
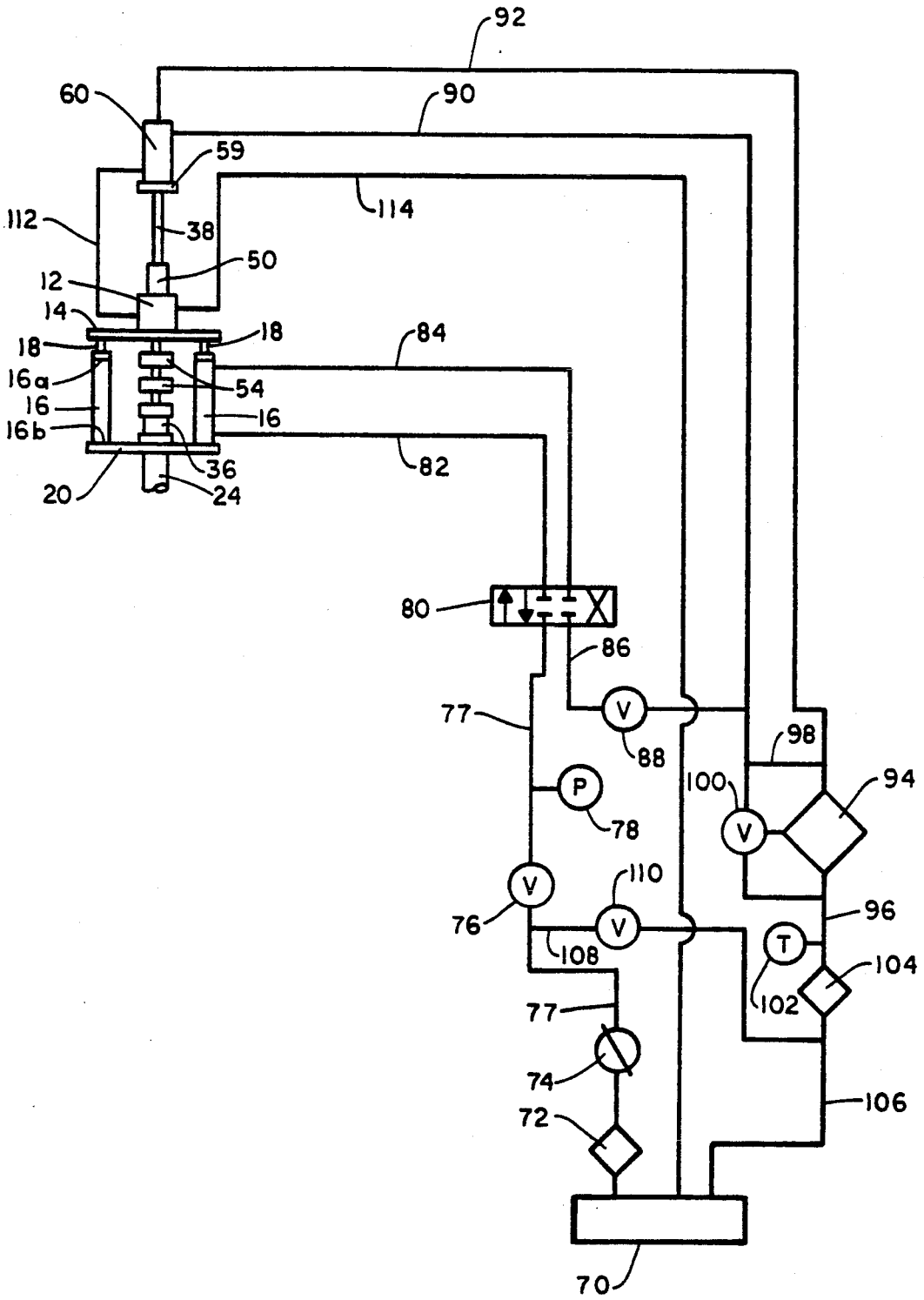
FIG. 4 is a diagrammatic view of a hydraulic fluid control system which actuates the raising and lowering of the piston rods.

Referring now to FIG. 4, a diagrammatic view of a hydraulic fluid control system is shown in detail. The hydraulic fluid control system provides hydraulic fluid to drive the motor 60 and to urge the piston rods 18 of the hydraulic cylinders 16 upwardly and downwardly. The hydraulic fluid control system includes a reservoir tank 70 which is adapted to provide a supply of hydraulic fluid for a hydraulic pump 74. The hydraulic pump 74 pumps hydraulic fluid through a flow control valve 76 and then into a first port of a four way, three position valve 80 (the valve 80 is in actuality preferably mounted to the bottom of the lower carrier plate 20) by way of a valve inlet piping 77. As is conventional and well known to those of ordinary skill in the art, the four way, three position valve 80 includes four ports adapted for fluid communication. The preferred hydraulic pump 74 comprises a variable volume, load sensing, pressure compensated, piston pump manufactured by Vickers Corporation. A strainer (filter) 72 can be disposed between the reservoir tank 70 and the hydraulic pump 74 for the purpose of removing foreign particles from the hydraulic fluid, particularly metal shavings. The strainer (filter) 72 is preferably a 100 mesh strainer.

A hydraulic cylinder lower piping 82 extends from a second port of the four way, three position valve 80 to the hydraulic cylinders 16. The hydraulic cylinder lower piping 82 branches into two different piping sections by way of a tee (not shown). These two different piping sections lead to the respective lower ends **16*b* of the hydraulic cylinders 16. The drawings have been simplified by illustrating only one of the hydraulic cylinders 16 as being connected to the hydraulic cylinder lower piping 82. In a similar manner, a hydraulic cylinder upper piping 84 extends from the respective upper ends 16*a* of the hydraulic cylinders to a third port of the four way, three position valve 80. The four way, three position valve 80 includes a fourth port which has a valve outlet piping 86 extending therefrom. The valve outlet piping 86 passes through a check valve 88 and into a motor inlet piping 90. The check valve 88 prevents a reverse flow of hydraulic fluid from the motor inlet piping 90 to the valve outlet piping 86**.

The motor inlet piping 90 supplies hydraulic fluid to the hydraulic motor 60. A motor outlet piping 92 extends from the hydraulic motor 60 to a cooler 94 which is adapted to maintain the temperature of the hydraulic fluid below a preselected maximum temperature and within a preferred temperature range. Optimal results have been obtained by utilizing a preselected maximum temperature of 160° F. and a preferred temperature range of 90°-120° F. A cooler outlet piping 96 extends from the cooler 94 to a filter 104. The temperature of the hydraulic fluid within the cooler outlet piping 96 is measured by a temperature gauge 102 which is used in connection with the cooler 94 to maintain the temperature of the hydraulic fluid in the preferred range. A cooler bypass piping 98 extends directly from the motor outlet piping 92 to the cooler outlet piping 96 and includes a cooler bypass valve 100.

The hydraulic fluid in the cooler outlet piping 96 is fed through the filter 104 which is preferably capable of separating out 10 micron particles from the hydraulic fluid. A reservoir inlet piping 106 extends from the filter 104 to the reservoir tank 70. Thus, the hydraulic fluid can be circulated again and again through the hydraulic fluid control system. It is most desirable to provide the reservoir tank 70 with a low level switch (not shown) which is capable of either setting off an alarm or automatically deactivating the hydraulic pump 74 in case the level of the hydraulic fluid in the reservoir tank 70 reaches a preselected minimum level.

A recirculating line 108 and a recirculation valve 110 are preferably provided. The recirculating line 108 extends from the valve inlet piping 77 at a point between the hydraulic pump 74 and the flow control valve 76. Thus, a small closed loop comprising the recirculating line 108, the valve 110, the reservoir inlet piping 106, the reservoir tank 70, the strainer (filter) 72, the pump 74, and the valve inlet piping 77 is included in the hydraulic fluid control system. If desired, the recirculation valve 110 can be opened and the flow control valve 76 closed to provide for a continuous recirculation of hydraulic fluid through this small closed loop without activating the hydraulic motor 60 or the hydraulic cylinders 16.

A hydraulic motor drain line 112 can extend from a lower portion of the hydraulic motor 60 to a lower portion of the load bearing 12. The hydraulic motor drain line 112 provides a small flow, preferably 0.5 to 2 gal/min, of hydraulic fluid to the load bearing 12 to lubricate the load bearing 12 and prevent the leaking of hydraulic fluid around the seals 68 (FIG. 3) within the load bearing 12. A load bearing outlet piping 114 extends from an upper portion of the load bearing 12 to the reservoir tank 70. Therefore, because the drain line 112 leads into the lower portion of the load bearing 12 and the outlet piping 114 extends from an upper portion of the load bearing 12, it is readily apparent that the load bearing 12 has a continuous and adequate supply of hydraulic fluid flowing therethrough.

In operation, the sucker rod lifting apparatus 10 is actuated by activating the pump 74 to cause a flow of fluid through the flow control valve 76 and into the four way, three position valve 80. The four way, three position valve 80 includes a conventional toggle switch (not shown) which is capable of causing the valve to operate in three different positions. The first position comprises a spring centered to neutral position which permits a flow of hydraulic fluid from the valve inlet piping 77 to the valve outlet piping 86. Thus, when the toggle switch is in the first position, the hydraulic motor 60 is driven by hydraulic fluid.

When the toggle switch is thrown to a second position, the valve 80 provides a flow of hydraulic fluid from the valve inlet piping 77 to the hydraulic cylinder lower piping 82 and into the lower ends **16*b* of the hydraulic cylinders 16 to actuate a raising of the piston rods 18 (an upstroke). If the upper clamp 50 is securely gripping the elongated rod 38, this raising of the piston rods 18 will also bring about a raising of the elongated rod 38. Of course, this raising of the elongated rod 38 also causes a vertically upward movement of the attached sucker rod 40 and attached rotor 42, thereby dislodging the rotor 42 from the stator 44 or reducing the torque exerted on the system. During this vertically upward movement of the piston rods 18, the valve 80 permits residual hydraulic fluid in the hydraulic cylinder upper piping 84 to communicate with the valve outlet piping 86**.

If the toggle switch is not fully thrown to the second position, but thrown to a position between the first and second positions, the valve 80 will permit some flow of hydraulic fluid from the piping 77 to the piping 86 while permitting some flow of hydraulic fluid into the piping 82 to cause a gradual, vertically upward movement of the piston rods 18. Therefore, if the toggle switch is held in this intermediate position, it is possible to simultaneously lift the elongated rod 38 while rotating it. This simultaneous lifting and rotation of the elongated rod 38 has been found to be advantageous because the rotation assists in dislodging the rotor from the stator.

Similarly, the toggle switch can be thrown to a third position which permits a flow of fluid between the piping 77 and the hydraulic cylinder upper piping 84 which drives the piston rods 18 downwardly (a downstroke). Residual fluid remaining in the lower piping 82 is thereby urged through the valve 80 and into the valve outlet piping 86. If the upper clamp 50 is securely gripping the elongated rod 38, this downstroke of the piston rods 18 will also bring about a downward movement of the elongated rod 38, the attached sucker rod 40 and attached rotor 42, thereby reinserting the rotor 42 into the stator 44. Again, if the toggle switch is held in a position between the first and third positions, it is possible to simultaneously rotate the elongated rod 38 as well as urge the elongated rod 38 vertically downwardly. This simultaneous rotation and downward urging of the elongated rod 38 has been found to be advantageous because the rotation assists in the insertion of the rotor into the stator.

As is somewhat obvious, the toggle switch is thrown to the third position to drive the piston rods 18 downwardly and thereby place the rotor in its original vertical position within the stator. Alternatively, the rotor can be placed in a different vertical position by manually throwing the toggle switch into the first position (neutral) at any desired point in the downstroke of the piston rods 18. From the foregoing it will be seen that the sucker rod lifting apparatus 10 dislodges and reinserts the rotor within the stator without disconnecting surface equipment or losing pressure across the packing inside the stuffing box 36. Accordingly, the present invention provides a significant advance over the prior art and permits substantially continuous production of oil at the well.

The elongated rod 38 comprises a number of individual sections of piping which are threaded together. It is desirable to sometimes remove one or more of these individual piping sections. With reference to FIGS. 1, 2 and 4, it is possible to remove one or more of these individual sections of piping by clamping the elongated rod 38 with the upper clamp 50, raising the piston rods 18 as described above to pull the elongated rod 38 upwardly, and then moving the lower clamps 54 downwardly relative to the elongated rod 38 until the lower clamps 54 are adjacent the stuffing box 36. The next two steps require a clamping of the elongated rod 38 by the lower clamps 54 and then an unclamping of the elongated rod 38 by the upper clamp 50. Next the piston rods 18 can be lowered as described above. If the above steps are followed correctly, the elongated rod 38 will not move when the piston rods 18 are lowered. Moreover, upon lowering of the piston rods 18, the horizontal bracket 58 and the sleeve 59 move downwardly relative to the hydraulic motor 60 which remains relatively stationary. If desired, the above steps can be followed again to expose a further length of the elongated rod 38.

Once the desired length of the elongated rod 38 is exposed, individual sections of piping of the elongated rod 38 can be removed by disconnecting the hydraulic motor 60 from the elongated rod 38, unthreading the piping sections, and then reconnecting the hydraulic motor 60 to the elongated rod 38. Incidentally, it will be appreciated that the lower clamps 54 are only needed when removing individual piping sections of the elongated rod 38. During the other above-described operations, the lower clamps 54 can either be clamped or unclamped to the elongated rod 38. Also, while the invention has been described in connection with hydraulic fluid, this should be understood to comprise any fluid suitable for the above-described operations. For instance, the hydraulic fluid can comprise a conventional automobile motor oil.

The sucker rod lifting apparatus 10 of the present invention fills several needs of the prior art. The sucker rod lifting apparatus 10 provides a convenient and economical hydraulic lift mechanism which is capable of dislodging a stuck rotor from a stator. The apparatus is convenient because a disconnection of surface equipment or piping is not required and is economical because production downtime is not encountered due to the use of the apparatus (there is no loss of pressure across the packing inside the stuffing box 36). The lifting apparatus can be left in place at the well even during normal production operations and is capable of dislodging a stuck rotor from a stator upon the mere flick of a toggle switch.

Reasonable variation and modification are possible within the spirit of the foregoing specification and drawings without departing from the scope of the invention. For example, it is possible to replace the hydraulic motor 60 with an electric motor or an air motor for rotatively driving the elongated rod 38. The hydraulic cylinders 16 would still be needed to raise and lower the sucker rod 40. Secondly, the upper clamp 50 could also be used as the lower clamp assembly 52 or vice versa.

Thirdly, it is possible to rotatively drive the elongated rod 38 using a hydraulic motor having a right angle drive attached to it. In this modification, the upper clamp 50 would preferably be placed above the right angle drive unit. Thus, if there were a need to remove individual piping sections of the elongated rod 38, these could be removed without having to disconnect the hydraulic motor or the right angle drive unit from the elongated rod 38.

Whereas the invention has been described with reference to the use of two hydraulic cylinders, the cylinders can be gas cylinders instead of hydraulic cylinders. Further, a single fluid cylinder, whether hydraulic or gas, can be used. If a gas cylinder is used, a pneumatic logic system or electrical control system can be used to control the flow gas to the gas cylinders. A pneumatic logic system or an electrical control system can be used with the hydraulic cylinders as well.

The embodiments for which an exclusive property or privilege is claimed are defined as follows:

1. In an apparatus for pumping oil from a well which includes a well casing and a tubing string mounted in the well casing, the apparatus comprising a rotary pump stator mounted to the lower end of the tubing string; a first carrier plate supported on the ground above the well casing; a sucker rod disposed in the well casing and supported by the first carrier plate; a rotary pump rotor mounted to the lower end of the sucker rod and in register with the rotary pump stator for pumping fluid from a producing formation at the lower end of the tubing string; and a motor mounted to the first carrier plate and coupled to the sucker rod to rotatively drive the sucker rod; the improvement comprising:

at least one fluid cylinder between the first carrier plate and the ground;

a fluid circuit connected to the fluid cylinder to raise and lower the first carrier plate with respect to the ground; and a control valve in the fluid circuit to selectively control the flow of fluid through the fluid circuit to selectively control the raising and lowering of the first carrier plate with respect to the ground to thereby selectively raise and lower the sucker rod and the pump rotor with respect to the pump stator.

2. An oil pumping apparatus according to claim 1 further comprising a second carrier plate mounted to a lower portion of the fluid cylinder.

3. An oil pumping apparatus according to claim 2 wherein there are two fluid cylinders mounted to opposite sides of the sucker rod.

4. An oil pumping apparatus according to claim 3 wherein the motor is a hydraulic motor, the fluid cylinder is a hydraulic cylinder and the fluid circuit includes the hydraulic motor.

5. An oil pumping apparatus according to claim 4 wherein the control valve has a position to permit fluid flow to the hydraulic cylinder and to the hydraulic motor simultaneously.

6. An oil pumping apparatus according to claim 4 wherein the control valve has a second position to block the flow of fluid to the hydraulic motor while permitting fluid flow to the hydraulic cylinder.

7. An oil pumping apparatus according to claim 1 wherein the motor comprises an electric motor.

8. An oil pumping apparatus according to claim 1 wherein the sucker rod is connected to the motor through a plurality of elongated rods which extend through a stuffing box, and the oil pumping apparatus further comprises a clamp adapted to mount to one of the elongated rods and rest on the stuffing box to hold the sucker rod in a predetermined raised position and thereby permit removal of another elongated rod above the elongated rod after the elongated rods have been raised by the fluid cylinder.

9. An oil pumping apparatus according to claim 8 and further comprising a second clamp supported by the first carrier plate and adapted to mount to another of the elongated rods above the first carrier plate to raise the elongated rods with the first carrier plate as the fluid cylinder raises the first carrier plate.

10. An oil pumping apparatus according to claim 1 further comprising a vertical support mounted on the first carrier plate and a bracket extending laterally from the vertical support, wherein the motor is supported on the bracket so that the motor can be raised with respect to the first carrier plate.

11. An oil pumping apparatus according to claim 1 wherein the fluid cylinder is a hydraulic cylinder.

12. An oil pumping apparatus according to claim 1 wherein there are two fluid cylinders mounted to opposite sides of the sucker rod.

13. An oil pumping apparatus according to claim 1 wherein the motor is a hydraulic motor, the fluid cylinder is a hydraulic cylinder and the fluid circuit includes the hydraulic motor.

14. In an apparatus for pumping oil from a well which includes a well casing and a tubing string mounted in the well casing, the pumping apparatus comprising a rotary pump stator mounted to the lower end of the tubing string; a first carrier plate supported on the ground above the well casing; a sucker rod disposed in the well casing and supported by the first carrier plate; a rotary pump rotor mounted to the lower end of the sucker rod and in register with the rotary pump stator for pumping fluid from a producing formation at the lower end of the tubing string; and a motor mounted to the first carrier plate and coupled to the sucker rod to rotatively drive the sucker rod; the improvement comprising:

means connected to the first carrier plate to selectively raise and lower the first carrier plate and thereby selectively raise and lower the sucker rod and the pump rotor with respect to the pump stator.

15. An oil pumping apparatus according to claim 14 and further comprising means to rotate the sucker rod and the rotor while raising the first carrier plate with respect to the ground.

* * * * *